US005544723A

United States Patent [19]

Gettemy

[11] Patent Number: 5,544,723

[45] Date of Patent: Aug. 13, 1996

[54] SELF-BELAYING APPARATUS

[76] Inventor: Donald J. Gettemy, 1350 Sioux, Los Alamos, N.M. 87544

[21] Appl. No.: 443,326

[22] Filed: May 17, 1995

[51] Int. Cl.[6] ..... B65H 59/24

[52] U.S. Cl. ..... 188/65.4; 188/65.1

[58] Field of Search ..... 188/65.1, 65.2, 188/65.3, 65.4, 65.5; 182/5, 6, 192, 239; 24/134 KB, 132 R, 134 P, 133; 114/239

[56] References Cited

U.S. PATENT DOCUMENTS

| | | | |
|---|---|---|---|
| 3,357,520 | 12/1967 | Foote | 188/65.4 |
| 3,470,982 | 10/1969 | Warden, Jr. | 182/192 |
| 3,757,901 | 9/1973 | Hobbs | 182/5 |
| 3,841,000 | 10/1974 | Simon | 188/65.1 |
| 3,967,349 | 7/1976 | Christensen . | |
| 4,217,847 | 8/1980 | McCloud . | |
| 4,474,262 | 10/1984 | Himmelrich | 188/65.5 |
| 4,576,248 | 3/1986 | Marom | 188/65.4 |
| 4,716,630 | 1/1988 | Skyba . | |
| 4,883,146 | 11/1989 | Varner et al. | 188/65.2 |
| 5,076,400 | 12/1991 | Petzl et al. . | |

*Primary Examiner*—Douglas C. Butler
*Attorney, Agent, or Firm*—Samuel M. Freund

[57] ABSTRACT

Self-belaying apparatus. An apparatus for permitting sport climbing without the assistance of a belayer is described. While the user is climbing, the apparatus slides along the climbing rope with little resistance. Any downward motion is immediately stopped, however. When the climber wishes to continue ascending, the apparatus automatically releases its grip on the rope. The apparatus, which includes a base, an elongated bar, a flat plate and a pulley, can also be used for rapelling.

4 Claims, 5 Drawing Sheets

SELF-BELAYING APPARATUS

FIELD OF THE INVENTION

The present invention relates generally to rope locking and jamming devices and, more particularly, to a self-jamming apparatus for a rope suitable for self-belaying and rapelling.

BACKGROUND OF THE INVENTION

With the continued popularity of top-rope climbing and rock gyms, there has been a need for self-belaying devices in the absence of suitable climbing partners for belaying the climber. Such devices would also be of value for top-rope activities where the rock is known to be unstable, thereby presenting significant danger to belayers.

Rope clamping devices which move substantially freely along a rope when it is not under significant tension are known. For example, U.S. Pat. No. 3,967,349 for "Clamp For Flexible Rope," which issued to Donald E. Christensen on Jul. 6, 1976, describes a self-tightening clamp assembly which may slide along a rope as long as the rope is flexible, but clamps onto the rope when the rope becomes taut, thereby reversibly securing the clamp along the rope. The self-tightening clamp assembly includes a clamp body having a longitudinal opening extending through it from end to end, for receiving a portion of a flexible rope so that the rope extends forward and rearward of the clamp assembly. Within the clamp body is a clamp surface that extends longitudinally along one side of the opening for engaging the rope. A clamp plate is movably mounted to the clamp body on an opposite side of the opening for engaging the rope and clamping it against the clamp surface. Lever means are provided, pivotably mounted to the clamp body, with one end operatively connected to the clamp plate and with a remaining end projecting rearwardly from the clamp body. The lever means functions to move the clamp plate toward the clamp surface in response to pivotal movement of the remaining lever end. Connecting means are also provided for releasably securing the remaining lever end to he flexible rope so that, as the rope is drawn to a taut condition between ends, the lever is automatically operated to force the clamp plate toward the clamp surface, thereby clamping the rope therebetween. In addition, as the rope slackens, the lever is automatically operated in response thereto to relax clamping pressure against the rope. As designed, the device requires that the rope be threaded through the opening in the clamp body, and that the rearward end of the rope flex sufficiently when not taut, in order or the clamp assembly to release. Additionally, if used in a climbing environment, a fall could easily occur which would not cause the rearward end of the rope to become taut, thereby causing the device to fail to clamp the rope.

Cam cleat devices which permit a rope to move freely therethrough in one direction, while automatically engaging and stopping a rope from passing in the opposite direction are well known. For example, U.S. Pat. No. 4,716,630 for "Cam Lock With Positive Release" which issued to Helmut K. Skyba on Jan. 5, 1988, and U.S. Pat. No. 4,217,847 for "Self-Release Cam Cleat" which issued to Robert A. McCloud on Aug. 19, 1980, describe such devices. Devices employing such camming apparatus are currently marketed for use in climbing as ascenders. However, once a fall has occurred, the rope is jammed so tightly by the cams that all weight must be removed from the rope in order to release it. That is, the climber must climb above the jammed ascender.

A device specifically designed for climbing is described in U.S. Pat. No. 5,076,400 for "Self-Jamming Safety Device For A Rope," which issued to Paul Petzl and Pierre Petzl on Dec. 31, 1991, where an internal cam locks in place under sudden force to prevent the rope from feeding out further. The device, which also can be used for rapelling, includes two pulleys, one of which is fixed on a base flange, and the other on a support plate capable of pivoting on an articulation spindle. The first pulley is provided with a first braking surface, against which the rope is pressed by a boss of the pulley when the support plate is driven by the tension in the rope to a first jamming position. The pulley is equipped with a second braking surface operating in conjunction with the first surface following continued pivoting movement of the support plate to a second jamming position. Switching between the two jamming positions takes place after the tension of the rope has exceeded a preset threshold. It should be pointed out that the rope is configured in an S-shape by the device, thereby adding significant resistance to motion of the rope therethrough while the user is climbing.

Both of the latter devices described hereinabove specify the use of pivoted members.

Accordingly, it is an object of the present invention to provide a climbing rope safety apparatus which automatically clamps the rope when a fall occurs.

Another object of the invention is to provide a climbing rope safety apparatus which automatically clamps the rope when a fall occurs, and which can be used as a descender.

Yet another object of the present invention is to provide a climbing rope safety apparatus which automatically clamps the rope when a fall occurs, but generates little resistance to the passage of the rope therethrough while the user is climbing in an upward direction.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the self-belaying apparatus of the invention may include an elongated base having an upper end and a lower end, a first axis along its long dimension, a first flange located closest to the upper end of said base, and a second flange spaced-apart from the first flange, the first flange and the second flange each having a circular hole centered along the first axis and adapted for slidably receiving a climbing rope, the first flange further having a tapered face opposing a flat face of the second flange; an elongated bar having an axis along its long dimension and a tapered portion at one end thereof through which a circular hole having its axis perpendicular to the second axis and adapted for slidably receiving the climbing rope, is placed, the bar being located between the first flange and the second flange in the base such that the axis of the hole in the bar is generally colinear with the first axis and the tapered portion of the bar faces the flat face of the second flange and tapers in the same general direction as the tapered face of the first flange; and a generally flat plate having a circular hole therein adapted for slidably receiving the climbing rope with some restriction, the plate being located adjacent to the second flange of the base such that the axis of the hole in the plate is generally colinear with the first axis, whereby the climbing rope may slide substantially unhindered through the apparatus in the direction from the upper end to the lower end of the base, while when moving in the opposite direction, the rope causes the plate to move against the tapered portion of the bar which in turn forces the holes in the bar and the plate to become out of alignment with the holes in the first flange and the second flange, thereby causing the climbing rope to reversibly bind in the apparatus.

Preferably, the apparatus also includes a pulley located in the vicinity of the lower end of the base on the side thereof opposite to the first flange and the second flange, for receiving the climbing rope, and wherein said base has a grooved portion adapted to permit the climbing rope to smoothly pass around the lower portion thereof and around the pulley, such that the self-belaying apparatus may be used for manually descending along the climbing rope when the free end of said bar is manually pushed toward the upper end of the base, thereby releasing the compression holding the rope.

Preferably also, the apparatus also includes means for confining the bar and the plate between the flanges of the base.

It is also preferred that the apparatus includes means for attaching the upper end of the base to the chest harness of a climber, and the lower end of the base to the seat harness of the climber.

Benefits and advantages of the invention include a simple, rugged, inexpensive and failsafe design suitable for outdoor use.

BRIEF DESCRIPTION OF THE DRAWINGS

The accompanying drawings, which are incorporated in and form a part of the specification, illustrate one embodiment of the present invention and, together with the description, serve to explain the principles of the invention. In the drawings.

DETAILED DESCRIPTION

Figure 1:
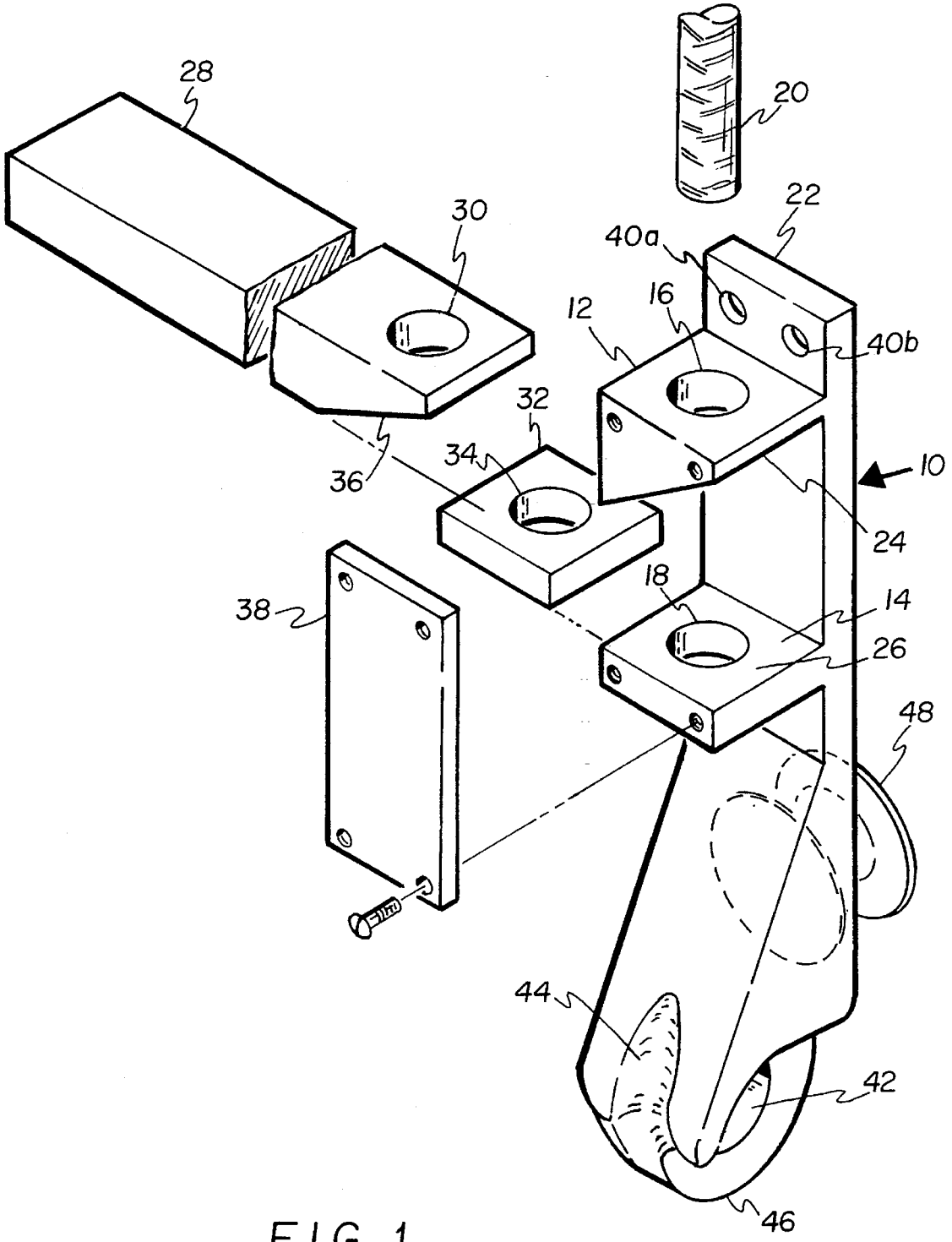
FIG. 1 is a schematic representation of a perspective view of the apparatus of the present invention showing all of the component parts thereof.

Reference will now be made in detail to the present preferred embodiments of the invention, and example of which is illustrated in the accompanying drawings. Identical or similar structure will be identified with identical callouts. FIG. 1 is a schematic illustration of a perspective view of the apparatus of the present invention showing all of the components thereof. Elongated base, 10, has two opposing flanges, 12 and 14, each having hole therein, 16 and 18, respectively, adapted for slidably receiving climbing rope, 20 without substantial sliding resistance, located in the upper portion, 22, thereof. Upper flange 12 has a tapered surface, 24 facing a substantially flat face, 26, of flange 14. Elongated bar, 28, having hole, 30, therein, and flat plate, 32, having hole, 34, therein, are disposed in the space created by flanges 12 and 14 in base 10, such that holes 16, 30, 32, and 18, are in alignment when a climber is ascending rope 20, and such that tapered portion, 36, in bar 28 faces plate 32 which is located next to flange 14. Cover plate, 38, is fastened to flanges 12 and 14 in order to prevent bar 28 from rotating such that the tapered portion thereof no longer tapers in the same general direction as the tapered portion 24 of flange 12. Hole, 30, in a similar manner to holes 16 and 18, is adapted for slidably receiving rope 20 without substantial sliding resistance, while hole 34 in plate 32 is adapted for receiving rope 20 with some resistance. Holes 40*a* and 40*b*, permit the self-belaying apparatus to be attached to the chest harness of the user, while hole 42 allows the apparatus to be attached to the seat harness thereof. Groove, 44, formed in the vicinity of the lower end, 46, of the apparatus, and pulley, 48, permit the user to use the apparatus for rapelling purposes, as will be described more fully hereinbelow.

Figure 2:
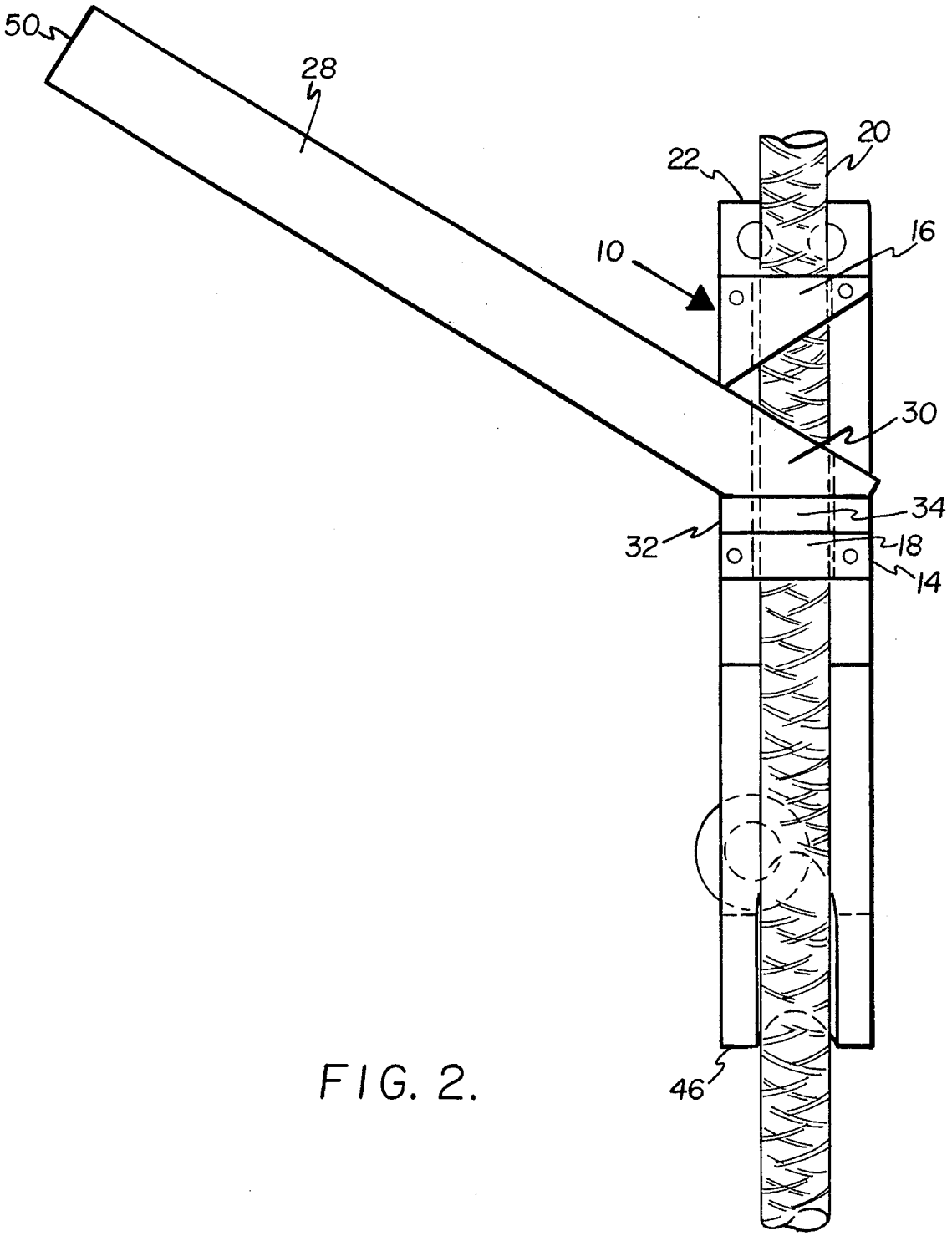
FIG. 2 is a schematic representation of the front view of the apparatus shown in FIG. 1 hereof, illustrating the orientation of the component parts in a normal climbing situation.
Figure 3:
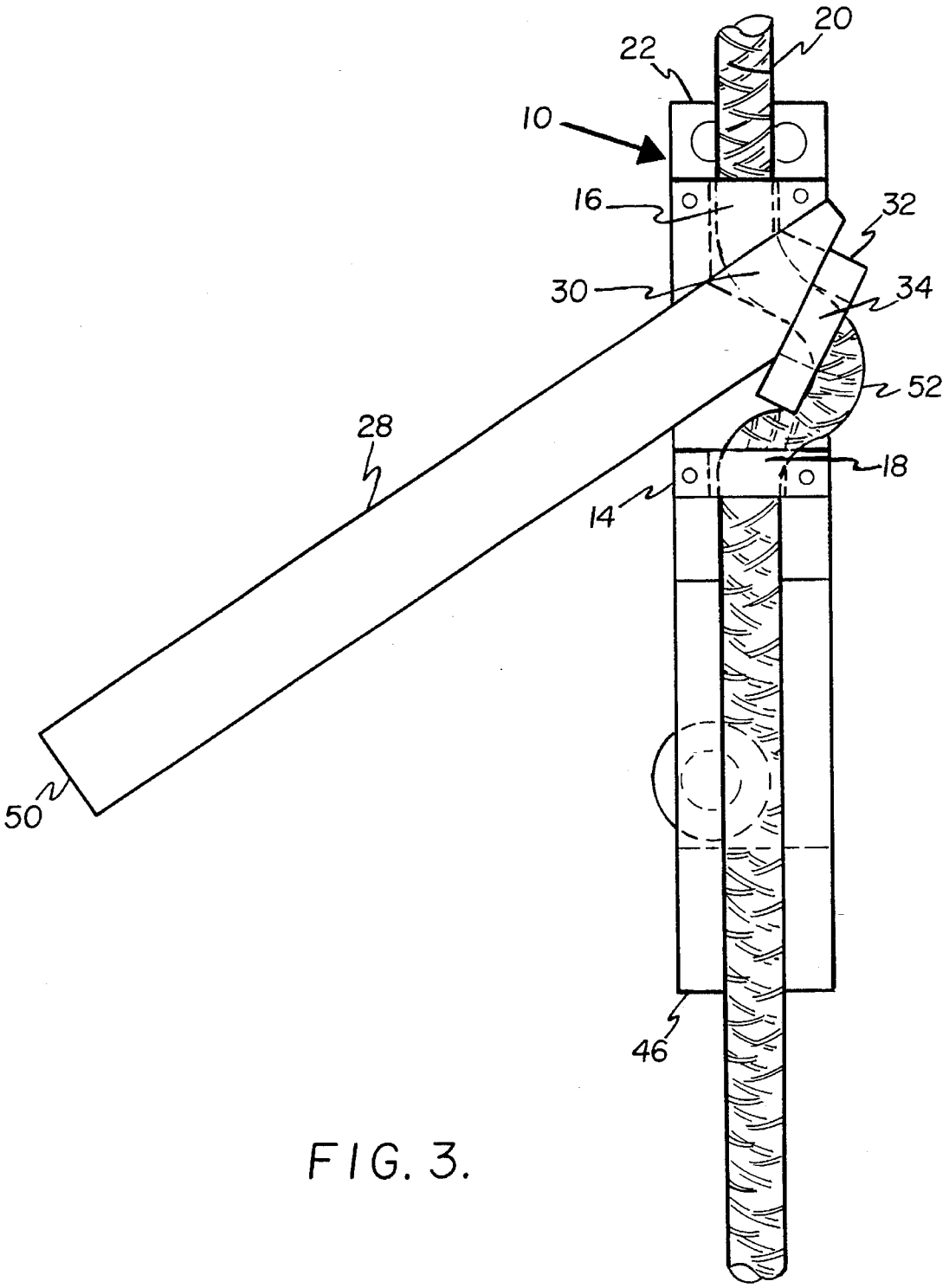
FIG. 3 is a schematic representation of the front view of the apparatus shown in FIG. 1 hereof, illustrating the orientation of the component parts in a stopped fall.

FIGS. 2 and 3 illustrate the present apparatus in actual operation. During a climb, the free end, 50, of bar 28 points in a generally upward direction as the rope, 20 slides through holes 16, 18, 30, and 34, as shown in FIG. 2 in the direction from top, 22, to bottom, 46. The rope below apparatus, 10, would either be tied or weighted. FIG. 3 illustrates the result of a fall. A combination of the weight of bar 28 and the friction developed in hole, 34 of plate, 32 as the rope slides in the direction from bottom 46 to top 22, causes the free end, 50, of bar 28 to move in a downward direction, forcing hole, 34 in plate, 32, and hole, 30, in bar, 28, to move out of alignment with holes 16 and 18 of apparatus, 10, thereby causing the rope to jam and stopping the descent of the climber. Rope, 20, may also bulge 52, between plate, 32, and flange, 14, which assists in the jamming process. It has been found that for an aluminum bar having a length of six inches, a width and thickness of one and one-half inches, respectively, and a taper angle of 30 degrees, a 180 pound climber is stopped in a few inches. Plate 32 is one-quarter inch thick and holes 16, 18, 30, and 34, are 1.27, 1.27, 1.23, and 1.19 cm in diameter, respectively, for a 10.5 mm diameter climbing rope, 20. After a fall, or in the situation where the climber is hanging from the present apparatus, rope, 20, may be released under tension by pushing bar 28 upward, or automatically, once the climber resumes climbing.

For added safety, a commercial cleat-type ascending device may be employed above the apparatus of the present invention. Since the present apparatus will stop the fall before the cleats of the commercial device grab the rope, the usual difficulty of having to climb above the device to remove the tension on the rope in order to release the cleats is avoided.

Figure 4:
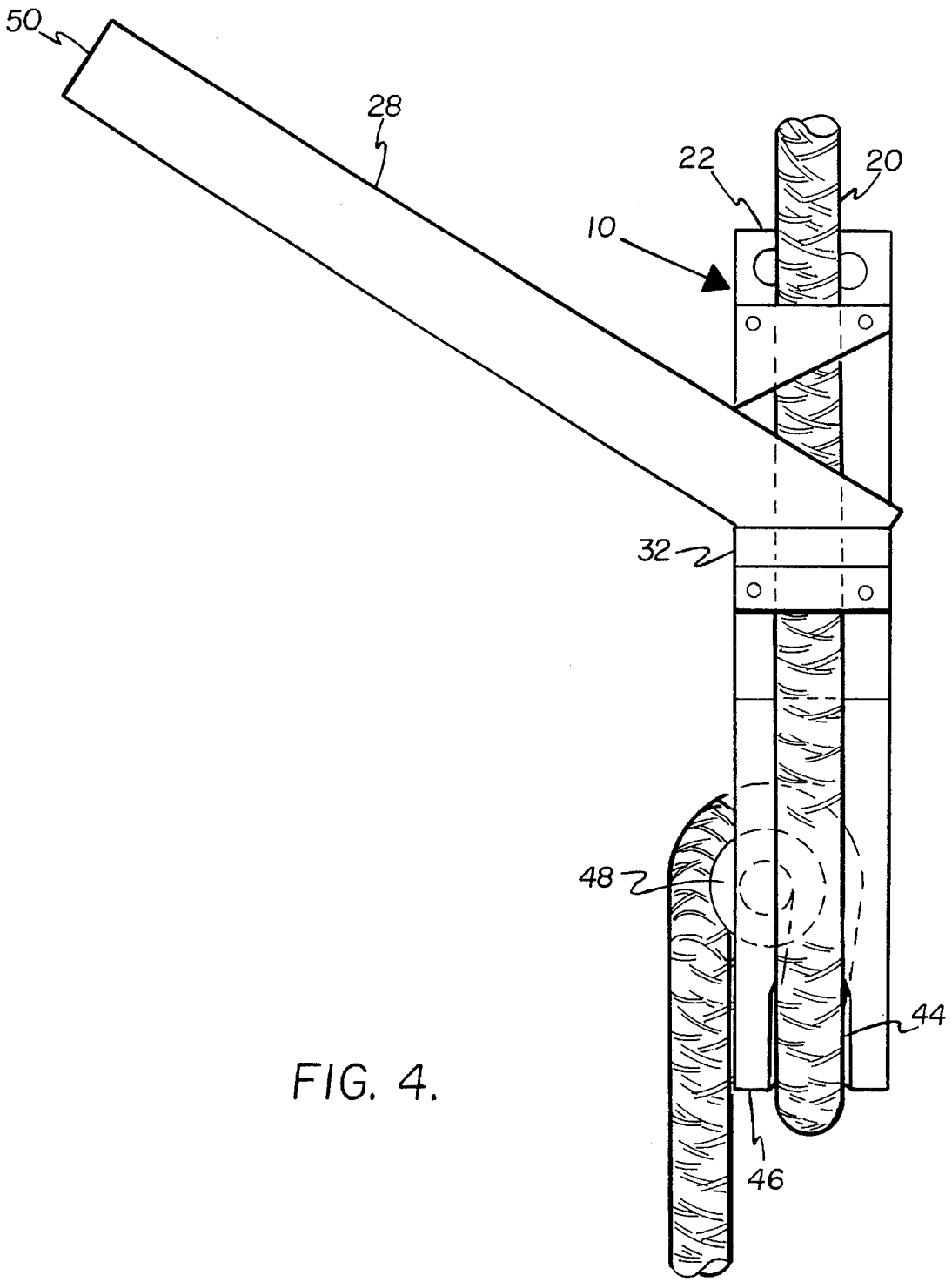
FIG. 4 is a schematic representation of the front view of the apparatus shown in FIG. 1 hereof illustrating the orientation of the component parts thereof in a rapelling situation.
Figure 5:
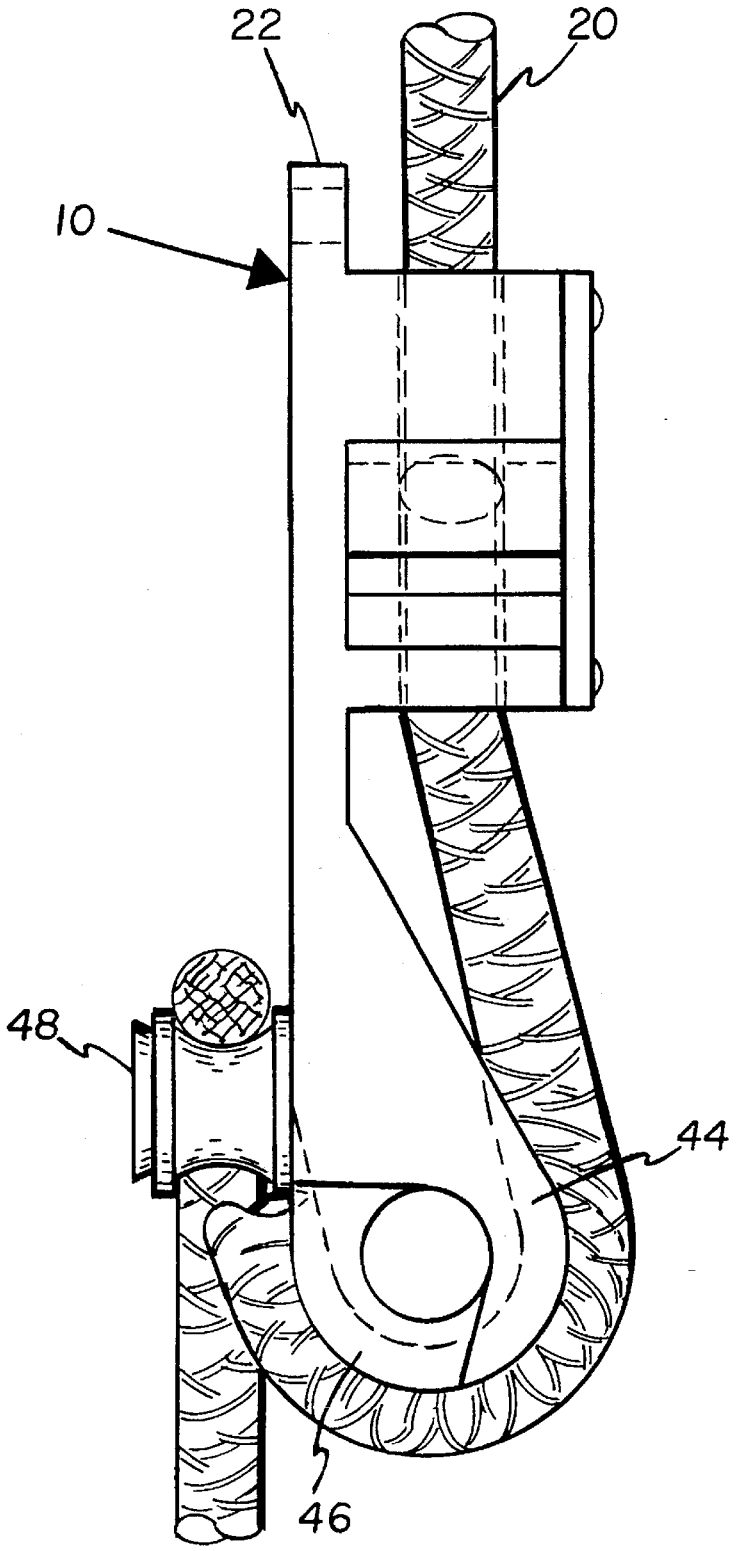
FIG. 5 is a schematic representation of a side view of the apparatus shown in FIG. 1 hereof illustrating the orientation of the component parts thereof in a rapelling situation.

FIGS. 4 and 5 illustrate the use of the present apparatus for rapelling. FIG. 4 shows the front view of apparatus, 10, while FIG. 5 shows a side view thereof. In both figures, bar, 28, is shown in its upward position (end, 50, pointed in an upward direction). In this position, rope, 20, slides essential freely through the apparatus.

The foregoing description of the invention has been presented for purposes of illustration and description and is not intended to be exhaustive or to limit the invention to the precise form disclosed, and obviously many modifications and variations are possible in light of the above teaching.

The embodiment was chosen and described in order to best explain the principles of the invention and its practical application to there by enable others skilled in the art to best utilize the invention in various embodiments and with various modifications as are suited to the particular use contemplated. It is intended that the scope of the invention be defined by the claims appended hereto.

What is claimed is:

1. A self-belaying apparatus comprising in combination:

a. an elongated base having an upper end and a lower end, a first axis along its long dimension, a first flange located closest to the upper end of said base, and a second flange spaced-apart from the first flange, the first flange and the second flange each having a circular hole centered along the first axis and adapted for slidably receiving a climbing rope, the first flange further having a tapered face opposing a flat face of the second flange;

b. an elongated bar having an axis along its long dimension and a tapered portion at one end thereof through which a circular hole having its axis perpendicular to the second axis and adapted for slidably receiving the climbing rope, is placed, said bar being located between the first flange and the second flange in said base such that the axis of the hole in said bar is generally colinear with the first axis and the tapered portion of said bar faces the flat face of the second flange and tapers in the same general direction as the tapered face of the first flange; and c. a generally flat plate having a circular hole therein adapted for slidably receiving the climbing rope with some restriction, said plate being located adjacent to the second flange of said base such that the axis of the hole in said plate is generally colinear with the first axis, whereby the climbing rope may slide substantially unhindered through said apparatus in the direction from the upper end to the lower end of said base, while when moving in the opposite direction, the rope causes said plate to move against the tapered portion of said bar which in turn forces the holes in said bar and said plate to become out of alignment with the holes in the first flange and the second flange, thereby causing the climbing rope to reversibly bind in said apparatus.

2. The self-belaying apparatus as described in claim 1, further having a pulley located in the vicinity of the lower end of said base on the side thereof opposite to the first flange and the second flange, for receiving the climbing rope, and where in said base has a grooved portion adapted to permit the climbing rope to smoothly pass around the lower portion thereof and around said pulley, such that said self-belaying apparatus may be used for manually descending along the climbing rope when the free end of said bar is manually pushed toward the upper end of said base, thereby releasing the compression holding the rope.

3. The self-belaying apparatus as described in claim 1, further comprising means for confining said bar and said plate between the flanges of said base.

4. The self-belaying apparatus as described in claim 1, further comprising means for attaching the upper end of said base to the chest harness of a climber, and the lower end of said base to the seat harness of the climber.

* * * * *